US006969206B2

(12) United States Patent
Iwanaga et al.

(10) Patent No.: US 6,969,206 B2
(45) Date of Patent: Nov. 29, 2005

(54) TENSION GENERATING MECHANISM FOR A PRINTING APPARATUS

(75) Inventors: Hidenori Iwanaga, Ibaraki (JP); Tsukasa Onose, Ibaraki (JP); Takeshi Terakado, Ibaraki (JP); Yuji Ohmura, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 146 days.

(21) Appl. No.: 10/382,653

(22) Filed: Mar. 7, 2003

(65) Prior Publication Data

US 2003/0177923 A1 Sep. 25, 2003

(30) Foreign Application Priority Data

Mar. 8, 2002 (JP) ..... P2002-063936
Jul. 11, 2002 (JP) ..... P2002-202888

(51) Int. Cl.[7] ..... B41J 15/16; B41J 13/02; B41J 11/26; B41F 13/54; B65H 23/18

(52) U.S. Cl. ..... 400/618; 400/641; 400/611; 400/621; 226/4; 226/42; 226/185

(58) Field of Search ..... 400/618, 641, 400/611, 582, 621; 347/104, 2; 101/228, 485, 484, 118, 44; 399/388, 313; 226/4, 31, 111, 152, 185

(56) References Cited

U.S. PATENT DOCUMENTS 3,411,686 A 11/1968 Bender ..... 226/185
4,011,976 A * 3/1977 Greer ..... 226/8
4,351,460 A * 9/1982 Ouellette ..... 226/25
4,359,178 A * 11/1982 Hayashi et al. ..... 226/25
4,589,644 A * 5/1986 Gratsch ..... 270/30.03
4,815,873 A * 3/1989 Hori ..... 400/154.4
4,818,126 A * 4/1989 Brooks et al. ..... 400/120.16
4,820,251 A * 4/1989 Blaser ..... 493/1
4,838,498 A * 6/1989 Huth ..... 242/420.3
4,863,086 A * 9/1989 Armelin ..... 226/152
5,028,965 A * 7/1991 Kinoshita et al. ..... 399/402
5,072,671 A * 12/1991 Schneider et al. ..... 101/467
5,209,589 A * 5/1993 Bliss ..... 400/568
5,452,632 A * 9/1995 Durr et al. ..... 83/13
5,485,386 A * 1/1996 Andreasson ..... 700/117
5,564,848 A * 10/1996 Quintana ..... 400/708
5,651,488 A * 7/1997 Goretzky ..... 226/190
5,709,331 A * 1/1998 Lam et al. ..... 226/4
5,774,777 A * 6/1998 Ohtsuka et al. ..... 399/384
5,847,742 A * 12/1998 Nishimura ..... 347/173
5,850,982 A * 12/1998 Roth et al. ..... 242/413.5
5,897,259 A * 4/1999 Ahn ..... 400/629

(Continued)

FOREIGN PATENT DOCUMENTS

DE 197 49 651 A1 11/1997
DE 101 06 949 A1 2/2001
GB 2181118 A * 4/1987 ..... B65H/39/16
JP 2001-335206 12/2001

*Primary Examiner*—Andrew H. Hirshfeld
*Assistant Examiner*—Wassem H. Hamdan
(74) *Attorney, Agent, or Firm*—McGinn & Gibb, PLLC

(57) ABSTRACT

A printing apparatus includes a conveyance mechanism for conveying a web to a transfer unit, and a tension generating mechanism for applying a tension to the web fed to the conveyance mechanism, wherein the tension generating mechanism includes a tension generating roller for changing the tension to be applied to the web in accordance with the rotational position, a tension guide that is rotated in accordance with the magnitude of tension generated by the roller, a first sensor for sensing the rotational position of the tension guide, a second sensor for sensing the rotational position of the tension generating roller, and a driver for controlling the rotation of the motor in accordance with the outputs of the first and second sensors.

8 Claims, 3 Drawing Sheets

U.S. PATENT DOCUMENTS 5,954,438 A * 9/1999 Klein et al. ..... 400/621
5,967,394 A * 10/1999 Crowley et al. ..... 226/31
5,979,732 A * 11/1999 Crowley et al. ..... 226/31
6,000,595 A * 12/1999 Crowley et al. ..... 226/15
6,052,144 A * 4/2000 Reyner ..... 347/262
6,056,180 A * 5/2000 Crowley et al. ..... 226/31
6,059,391 A * 5/2000 Fulkerson et al. ..... 347/2
6,106,177 A * 8/2000 Siegl et al. ..... 400/618
6,158,687 A * 12/2000 Widmer ..... 242/413.6
6,279,807 B1 * 8/2001 Crowley et al. ..... 226/31
6,293,669 B1 * 9/2001 Uchida ..... 347/104
6,305,857 B1 * 10/2001 Crowley et al. ..... 400/579
6,321,650 B1 * 11/2001 Ogawa et al. ..... 101/227
6,364,554 B2 * 4/2002 Huang et al. ..... 400/641
6,370,351 B1 * 4/2002 Puritscher et al. ..... 399/313
6,412,991 B1 * 7/2002 Klinefelter et al. ..... 400/240
6,467,900 B1 * 10/2002 Askren et al. ..... 347/104
6,592,276 B2 * 7/2003 Ohba et al. ..... 400/582
6,606,945 B1 * 8/2003 Shimatsu et al. ..... 101/225
2004/0020391 A1 * 2/2004 Glockner et al. ..... 101/485

* cited by examiner

TENSION GENERATING MECHANISM FOR A PRINTING APPARATUS

BACKGROUND OF THE INVENTION

1. Field of the Invention

The present invention relates to a printing apparatus for forming an image on a web that is continuously conveyed, and more particularly to a printing apparatus having a speed control mechanism for preventing transfer blurring from arising due to a variation in the web conveying speed.

2. Description of the Related Art

In the printing apparatus for forming the images on the continuous web, the web is conveyed by driving a tractor mechanism mounted on the printing apparatus with the pin members of the tractor mechanism engaged in perforations of the sheet. However, when the web with perforations was employed, there was a problem that both ends of the web with perforations must be cut out after printing, and the cutting operation was troublesome.

Therefore, a printing apparatus has been put into practical use in which the web without perforations is employed and conveyed by a conveying roller mechanism, instead of the tractor mechanism. However, in the printing apparatus for forming the image on the web without perforations, while conveying the web by the conveying roller mechanism, it is more difficult to correctly convey the web to the transfer unit when the printing speed is increased. A device for solving this problem was offered in JP-A-2001-335206.

This device includes a control mechanism for controlling the web transit position and the tension on the upstream side in a web conveying direction to the transfer unit, and a control mechanism for controlling the web transit position and the tension on the downstream side in the web conveying direction to the transfer unit to enable the web conveyance at high precision.

With the above constitution, the web is conveyed at high speed and high precision, but there is still a problem that the web is not necessarily correctly conveyed, when the conveyance load is abruptly changed, such as at the start time of printing.

That is, when the web conveyance is accelerated at the start time of printing, the load in the tension generating roller is abruptly varied. Then, the conveyance load of the web conveyance mechanism is varied, so that the web conveying speed is changed. Therefore, when the image is recorded on the web in the transfer unit, the transfer blurring arises.

Also, if the return conveyance is performed when the printing is stopped, the web is separated from the tension guide, and at the start time of next printing, an impact occurs when the web and the tension guide are contacted again, a vibration is transmitted to the transfer unit, resulting in a problem that the transfer blurring arises.

This problem is severe especially when the printing apparatus has a higher speed. That is, it has been found that the acceleration of the web conveyance speed is increased at the start time of printing, and the web tension is abruptly and excessively increased to make the transfer blurring more remarkable.

SUMMARY OF THE INVENTION

In view of the above, a first object of the present invention is to provide a printing apparatus with high printing quality in which the transfer blurring is reduced by stabilizing the conveyance speed during the normal transit of the web.

A second object of the invention is to provide a printing apparatus with high printing quality in which the transfer blurring is prevented from arising due to speed variations by suppressing a load on the web conveyance mechanism and increasing the web conveying speed smoothly at the start time of printing.

In order to achieve the first object, the present invention has one feature of having a transfer unit for transferring an image onto a web to be conveyed, a conveyance mechanism for conveying the web to the transfer unit, and a tension generating mechanism for applying a tension to the web fed to the conveyance mechanism, wherein the tension generating mechanism comprises a tension generating roller, a tension guide that is rotated in accordance with the magnitude of the tension generated in the roller, a first sensor for sensing the rotational position of the tension guide, and tension control means for controlling the tension applied to the web by the tension generating roller upon a sensed signal of the first sensor.

With this constitution, it is possible to keep the conveyance load of the web constant at any time, and suppress the speed changes of the web conveyance mechanism, whereby the transfer blurring due to conveyance speed variations is reduced.

Another feature of the invention is that the tension generated by the tension generating roller is controlled by changing the length of the web contact with the roller. With this constitution, the tension applied to the web is simply controlled.

Another feature of the invention is that means for controlling the tension generated by the tension generating roller comprises driving means for rotating the roller around a rotation shaft provided at an eccentric position, a pressing roller supported with an elastic body for pressing the web against the tension generating roller, and control means for controlling the driving means upon a sensed signal of the first sensor.

With this constitution, the contact length of the web with the tension generating roller is changed in accordance with a rotation angle of the roller.

In order to achieve the second object, the invention has a further feature in that the tension generating mechanism comprises a tension generating roller for changing the tension to be applied to the web in accordance with the rotational position, a second sensor for sensing the rotational position of the roller, and driving means for controlling the rotational position of the tension generating roller in accordance with a sensed signal of the second sensor.

In this manner, by controlling the tension applied to the web in accordance with an output of the second sensor, it is possible to prevent an abrupt and excessive tension from occurring at the start time of printing. That is, at the time of starting to convey the web, the rotational position of the roller is fixed where the tension applied to the web by the tension generating roller is minimum, and after starting to convey the web, the rotational position of the roller is changed to gradually increase the tension to be applied to the web, whereby it is possible to suppress variations in the web conveying speed and reduce the transfer blurring.

Other features and effects of the invention will be more apparent from the following description of the embodiments.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the invention with reference to the accompanying drawings.

Figure 1:
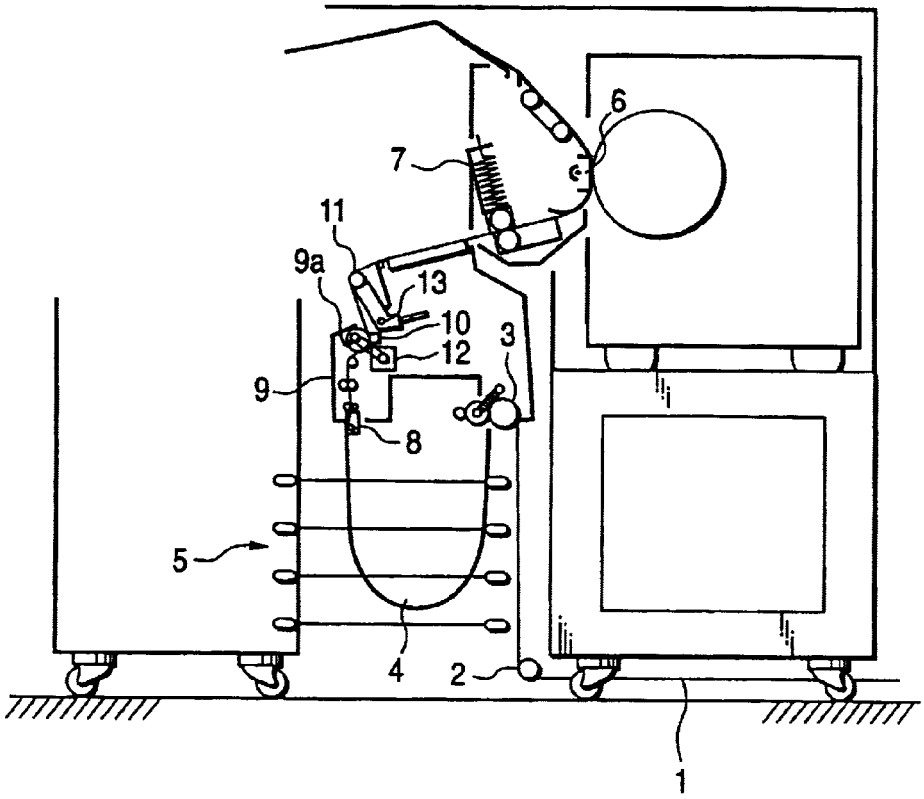
FIG. 1 is a schematic view showing one embodiment of a printing apparatus according to the present invention.

FIG. 1 shows one embodiment of a printing apparatus according to the present invention, in which reference numeral 1 denotes a web. In the printing apparatus, the web is usually the paper, but is not necessarily limited to the paper, and may be a plastic film.

The web 1 fed from a sheet feeder (not shown) disposed in the former stage of the printing apparatus is passed under a housing of the printing apparatus, via a guide roller 2, and conveyed via a web take-up roller 3 to an air loop mechanism 4.

The air loop mechanism 4 is controlled so that an amount of sagging in the web 1 is sensed by a sensor 5, and the speed of the web take-up roller 3 is varied in accordance with the amount of sagging to keep the amount of sagging constant. In FIG. 1, four optical sensors are employed to sense the amount of sagging. The web 1 is then conveyed to a transfer unit 6 for transferring the image onto the web 1 by a conveyance mechanism 7.

To correct the meandering of the web near an entrance of the web conveyance mechanism 7, a web edge guide 8 for correcting the transit position of the web is disposed in the latter stage of the air loop mechanism 4. The structure of a guide member for correcting the position of the web is well known, and disclosed in JP-A-2001-335206, for example, and its detailed description is omitted here. The web 1 is then subject to an adequate tension by a tension generating mechanism 9 equipped with a tension generating roller 9*a*, and transferred to the transfer unit 6 via a tension guide 11.

Figure 2:
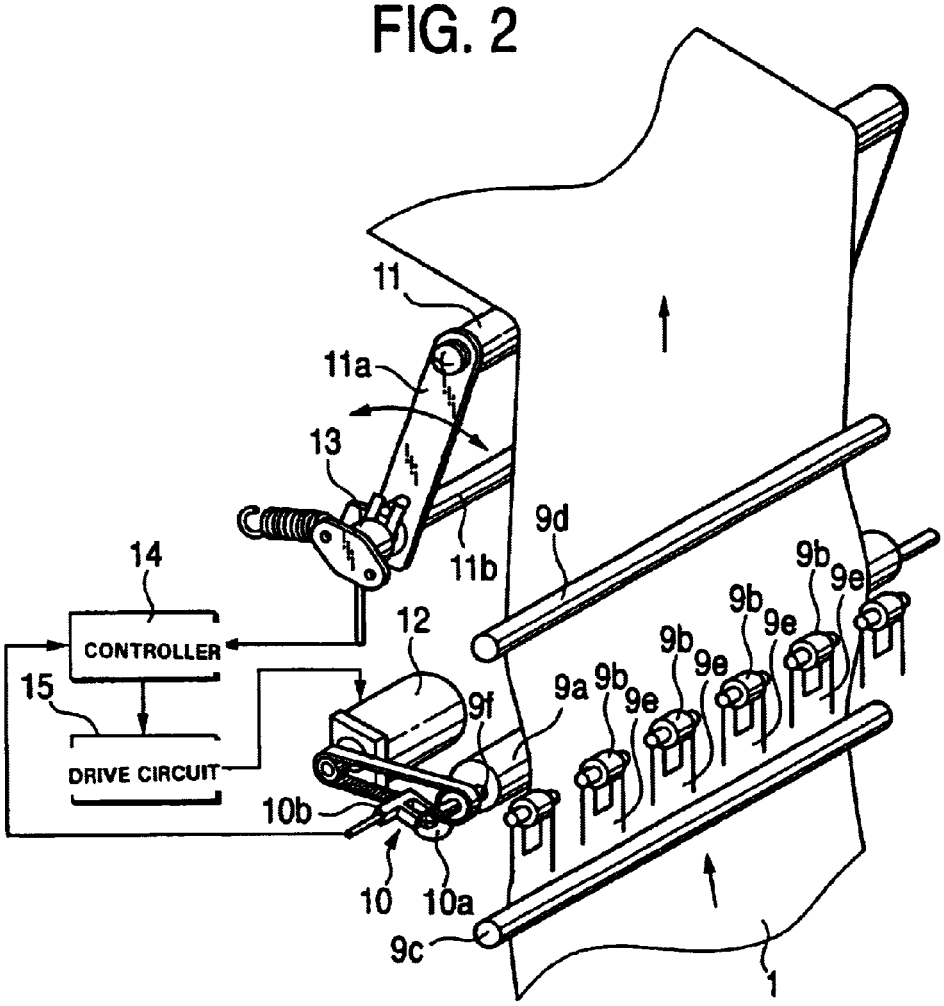
FIG. 2 is a constitution view showing one embodiment of a tension generating mechanism that is a principal portion of the invention.

Referring to FIG. 2, the structure of the tension generating mechanism 9 will be described below.

The web 1 transits to come into contact with a tension generating roller 9*a* while being led by the guide shafts 9*c* and 9*d*. A plurality of pressing rollers 9*b* are disposed opposed to the tension generating roller 9*a* on the opposite side of the web 1. The plurality of pressing rollers 9*b* generate a tension by pressing the web 1 against the tension generating roller 9*a* using a leaf spring 9*e*.

Figure 3:
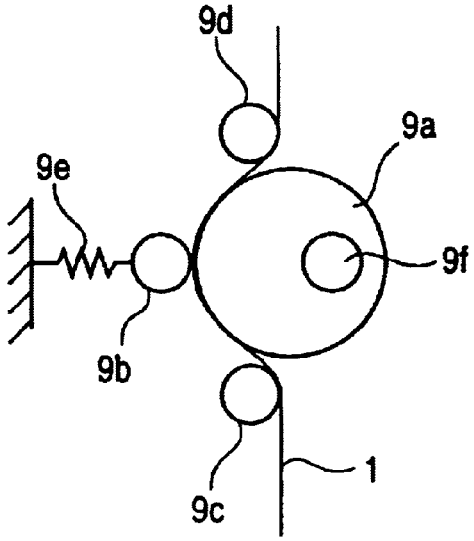
FIG. 3 is an explanatory view for explaining the operation of the tension generating mechanism of the invention.

A rotation shaft 9*f* of the tension generating roller 9*a* is connected to a stepping motor 12 for driving, so that the roller 9*a* is rotated along with the rotation of the motor 12. The rotation shaft 9*f* is attached at a position eccentric from a central axis of the tension generating roller 9*a*, as shown in FIG. 3. Accordingly, if the rotation shaft 9*f* and the pressing roller 9*b* are placed in a positional relation of FIG. 3, the tension applied to the web 1 is increased, while if they are placed in a positional relation of FIG. 4, the applied tension is smaller.

A roller detecting sensor 10 for detecting the rotational position of the tension generating roller 9*a* is formed of a disk 10*a* and a member 10*b* disposed to sandwich it. A light emitting diode (not shown) is provided on one side of the member 10*b*, and a light receiving element (not shown) is disposed on the other side, whereby the position of the roller 9*a* is detected by determining whether or not light is intercepted by a semi-disk 10*a*. That is, using the sensor 10, it is possible to determine whether the tension generating roller 9*a* is at the position of FIG. 3 or the position of FIG. 4, and discriminate whether the roller 9*a* is rotated in a direction where the tension applied to the web 1 is increased or decreased. The constitution of the sensor 10 is only exemplary, and various other constitutions may be taken by the well known technique. A signal detected by a roller position detecting sensor 10 is applied to a controller 14, and used as a control signal for controlling the motor 12.

On the other hand, the web 1 passing through a guide shaft 9*d* transits in contact with a tension guide 11. This tension guide 11 is attached to a tension arm 11*a*, which is supported rotatably around an axis 11*b*.

If the tension arm 11*a* is rotated in the direction of the arrow in the figure, its angle of rotation is detected by an angular position sensor 13. The details of the angular position sensor 13 are not shown, but the resistance value may be varied in accordance with the angle of rotation, for example. A sensed signal of this sensor 13 is applied to the controller 14, and used as a control signal for controlling the driving of the motor 12. An output signal of the controller 14 is applied via a drive circuit 15 of the motor to the drive motor 12 such as a stepping motor.

Of two sensors 10 and 13, the position detecting sensor 10 is mainly used for the control when a tension is abruptly generated in the web, such as at the start time of printing, and the angular position detecting sensor 13 is used normally to keep the web conveyance load applied to the web conveyance mechanism 8 constant. The control operation will be described below.

Figure 4:
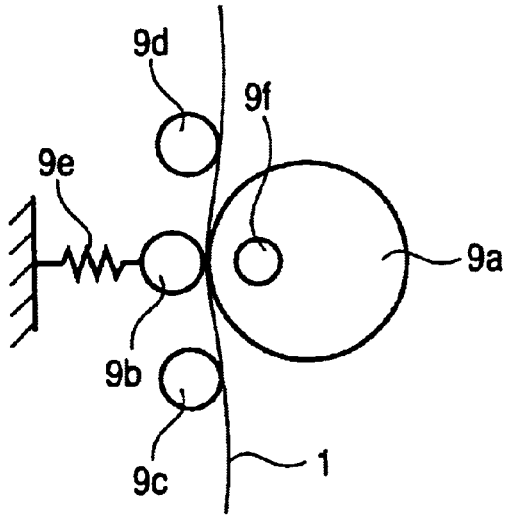
FIG. 4 is an explanatory view for explaining the operation of the tension generating mechanism of the invention.

First of all, at the start time of printing, the contact length of the web 1 with the roller 9*a* is minimized so that the arrangement between the tension generating roller 9*a* and the web 1 may have a positional relation, as shown in FIG. 4. Preferably, the exciting power of the drive motor 12 is controlled with a signal of the sensor 10 to be fixed in this state for some short time. Thereby, an abrupt and excessive tension is prevented from being applied to the web at the start of conveying the web, so that the web starts to be moved smoothly.

The tension generating roller 9*a* is gradually rotated as the web 1 transits, whereby the rotation of the drive motor 12 is controlled to increase the contact length of the web 1 with the roller 9*a*. And the contact length is adjusted so that the tension guide 11 comes to a normal position. In this way, the web 1 can be conveyed without generating abrupt and excessive tension in the web 1.

Figure 5:
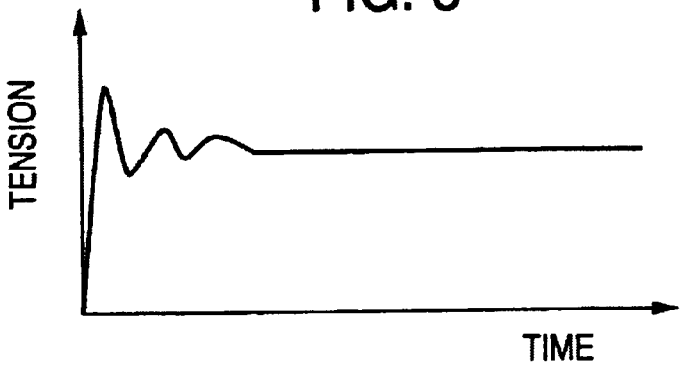
FIG. 5 is a graph for explaining changes in the web tension at the start time of printing in the conventional apparatus.
Figure 6:
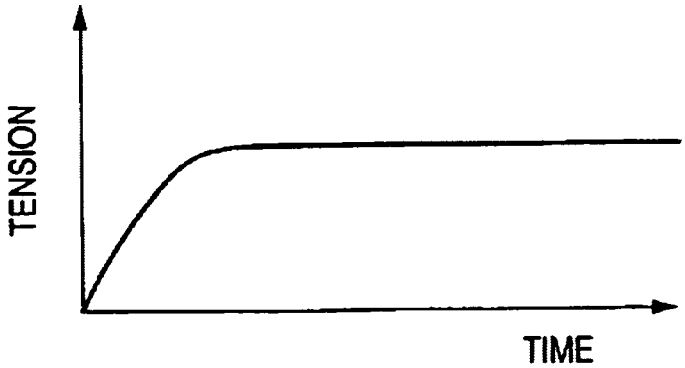
FIG. 6 is a graph for explaining changes in the web tension at the start time of printing in the inventive apparatus.

FIGS. 5 and 6 show how the tension is applied to the web 1 at the start time of printing. FIG. 5 shows how the tension is applied to the web 1 in the case of the conventional apparatus without the sensor 10 and the controller 14. As will be clear from FIG. 5, the tension applied to the web 1 undergoes greatly hunting, so that the transfer blurring is caused at the start time of printing. On the contrary, under the control of the invention, the tension applied to the web 1 is smoothly changed as shown in FIG. 6, so that the transfer blurring can be prevented at the start time of printing by suppressing fluctuations in the web conveying speed.

Normally, the tension guide 11 is controlled to retain a predetermined position. When the tension guide 11 is rotated from the normal position in a left direction of the arrow of FIG. 2, or to the side of the web conveyance mechanism, its rotational angle is sensed by the sensor 13, and in accordance with its sensed signal, the roller 9*a* is controlled to be rotated to a position where the contact length of the web 1 with the tension generating roller 9*a* is decreased.

Conversely, when the tension guide 11 is rotated in a right direction of the arrow, or to the side of the tension generating mechanism 9, the tension generating roller 9*a* is controlled to be rotated, in accordance with a signal of the sensor 13, to a position where the contact length of the web 1 with the tension generating roller 9*a* is increased. In this way, the generated tension is adjusted by changing a frictional force of the tension generating roller 9*a* with the web 1, so that a constant web conveyance load is applied to the web conveyance mechanism 7.

With the above constitution, in the case where the sensor 10 is not provided but the sensor 13 is only provided, if the printing speed is as low as 35 ips, for example, the transfer blurring can be prevented. However, if the printing speed exceeds 50 ips, the detection speed of the guide position detecting sensor 13 for the tension guide 11 and the response speed of the drive motor 12 for the tension generating roller 9*a* do not follow. When there is an abrupt change in the load at the start time of printing, any satisfactory result is not obtained. Accordingly, it is more preferable to employ the sensed signals of both the sensors 10 and 13 for the control, but this invention is not limited to the control device with both the sensors.

When the printing is stopped, the tension generating roller 9*a* is rotated in a reverse direction to the conveying direction during the printing to control the contact length of the web 1 with the tension generating roller 9*a* to be minimized, namely, in the positional relation of FIG. 4, before starting the next printing. This control is easily made using the sensed signal of the sensor 10, because the rotational position of the tension generating roller 9*a* is detected by the sensor 10.

Under this control, the tension generating roller 9*a* is always at the position where the tension applied to the web 1 is minimum at the start time of printing, in which the tension guide 11 is slightly inclined toward the tension generating roller 9*a*. And if the web 1 starts to be moved, the tension guide 11 is gradually rotated to the web conveyance mechanism, the web is conveyed continuously with the tension guide 11 at the normal position.

As above described, with this invention, the initial position of the tension generating roller is fixed where the occurrence of web tension is smaller, and the rotation of the roller is controlled so that if the web starts to be moved, the web tension is gradually increased to suppress an abrupt and excessive occurrence of the web tension. Accordingly, it is possible to suppress an abrupt change in the web conveyance load, and minimize the variation in the conveying speed of the web conveyance mechanism, whereby the transfer blurring is reduced.

Normally, the tension guide is always held at the fixed position, whereby the web conveyance load is kept constant by a combination of loads due to a reaction force of the tension guide and a frictional force of the tension generating roller. Accordingly, the variation in the conveying speed of the web conveyance mechanism is minimized and the transfer blurring due to variations in the web conveying speed is reduced.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A printing apparatus for forming an image on a web to be conveyed, comprising:

a transfer unit for transferring the image onto the web;

a conveyance mechanism for conveying the web to said transfer unit; and a tension generating mechanism for applying a tension to the web fed to the conveyance mechanism, wherein the tension generating mechanism comprises:

a tension generating roller;

a tension guide that is rotated in accordance with a magnitude of the tension generated in the tension generating roller;

a first sensor for sensing the rotational position of the tension guide; and a tension controller for controlling a tension applied to the web by the tension generating roller upon a sensed signal of the first sensor by changing a manner by which said tension generating roller contacts said web, wherein the tension controller comprises:

a driver for rotating the tension generating roller around a rotation shaft provided at an eccentric position;

a pressing roller supported with an elastic body for pressing the web against the tension generating roller; and a controller for controlling the driver upon a sensed signal of the first sensor.

2. A printing apparatus for forming an image on a web to be conveyed, comprising:

a transfer unit for transferring the image onto the web;

a conveyance mechanism for conveying the web to the transfer unit; and a tension generating mechanism for applying a tension to the web fed to the conveyance mechanism, wherein the tension generating mechanism comprises:

a tension generating roller having a rotation shaft at an eccentric position;

a pressing roller for pressing the web against the tension generating roller;

a sensor for sensing a rotational position of the tension generating roller; and a driver for controlling the rotational position of the tension generating roller in accordance with a sensed signal of the sensor.

3. The printing apparatus according to claim 2, wherein, at a time of starting to convey the web, the rotational position of the roller is fixed where the tension applied to the web by the tension generating roller is a minimum, and after starting to convey the web, the rotational position of the roller is changed to gradually increase the tension applied to the web.

4. A printing apparatus for forming an image on a web to be conveyed, comprising:

a transfer unit for transferring the image on to the web;

a conveyance mechanism for conveying the web to the transfer unit; and a tension generating mechanism for applying a tension to the web fed to the conveyance mechanism, wherein the tension generating mechanism comprises:

a tension generating roller for changing the tension to be applied to the web in accordance with a rotational position of said tension generating roller;

a tension guide that is rotated in accordance with the magnitude of tension generated by the roller;

a first sensor for sensing an angle of rotation of the tension guide;

a second sensor for sensing the rotational position of the tension generating roller; and a driver for controlling the rotation of the tension generating roller in accordance with the outputs of the first and second sensors.

5. The printing apparatus according to claim 4, wherein at a time of starting to convey the web, the rotational position of the roller is fixed where the tension applied to the web by the tension generating roller is a minimum, in response to a sensed signal of the first sensor, and after starting to convey the web, the rotational position of the roller is changed to gradually increase the tension applied to the web.

6. The printing apparatus according to claim 4, wherein the tension guide is normally controlled to retain a predetermined position in response to a sensed signal from the second sensor.

7. A printing apparatus for forming an image on a web to be conveyed, comprising:

a transfer unit for transferring the image onto the web;

a conveyance mechanism for conveying the web to the transfer unit; and a tension generating mechanism for applying a tension to the web fed to the conveyance mechanism, wherein the tension generating mechanism comprises:

a tension generating roller having a rotation shaft at an eccentric position;

a pressing roller for pressing the web against the tension generating roller;

a tension guide that is rotated in accordance with a magnitude of tension generated by the tension generating roller;

a first sensor for sensing an angle of rotation of the tension guide;

a second sensor for sensing the rotational position of the tension generating roller; and a driver for controlling the rotational position of the tension generating roller in accordance with the sensed signals of the first and second sensors.

8. A printing apparatus for forming an image on a web to be conveyed, comprising:

a transfer unit for transferring the image onto the web;

a conveyance mechanism for conveying the web to said transfer unit; and a tension generating mechanism for applying tension to the web fed to the conveyance mechanism, wherein the tension generating mechanism comprises:

a tension generating roller;

a tension guide that is rotated in accordance with a magnitude of the tension generated in the tension generating roller;

a first sensor for sensing a rotational position of the tension guide; and a tension controller for controlling a tension applied to the web by the tension generating roller upon a sensed signal of the first sensor by changing a manner by which said tension generating roller contacts said web, wherein the tension generating roller comprises:

a rotation shaft connected to a motor for driving the rotation shaft such that the tension generating roller is rotated along with the rotation of the motor, wherein the rotation shaft is attached at a position eccentric from a central axis of the tension generating roller.

* * * * *